US009339087B2

(12) United States Patent
Nishida

(10) Patent No.: US 9,339,087 B2
(45) Date of Patent: May 17, 2016

(54) INCORPORATED SLIDE FASTENER

(75) Inventor: Eiji Nishida, Toyama (JP)

(73) Assignee: YKK Corporation (JP)

( * ) Notice: Subject to any disclaimer, the term of this patent is extended or adjusted under 35 U.S.C. 154(b) by 204 days.

(21) Appl. No.: 13/976,646

(22) PCT Filed: Dec. 28, 2010

(86) PCT No.: PCT/JP2010/073794
§ 371 (c)(1),
(2), (4) Date: Jun. 27, 2013

(87) PCT Pub. No.: WO2012/090324
PCT Pub. Date: Jul. 5, 2012

(65) Prior Publication Data

US 2013/0298358 A1 Nov. 14, 2013

(51) Int. Cl.
*A44B 19/34* (2006.01)
*A44B 19/12* (2006.01)
*D03D 1/00* (2006.01)

(52) U.S. Cl.
CPC ..... *A44B 19/346* (2013.01); *A44B 19/12* (2013.01); *D03D 1/00* (2013.01); *D10B 2501/0631* (2013.01); *Y10T 24/2521* (2015.01)

(58) Field of Classification Search
CPC ... A44B 19/12; A44B 19/346; Y10T 24/2521
USPC ..... 24/393
See application file for complete search history.

(56) References Cited

U.S. PATENT DOCUMENTS 3,765,457 A * 10/1973 Glindmeyer ..... A44B 19/10 139/116.1
4,058,144 A * 11/1977 Dal Negro ..... A44B 19/54 139/384 B
4,220,182 A * 9/1980 Glindmeyer ..... A44B 19/346 139/384 B (Continued)

FOREIGN PATENT DOCUMENTS

BR 9101149 A 11/1991
BR 100897 A 10/2001

(Continued)

OTHER PUBLICATIONS

International Search Report, PCT Application No. PCT/JP2010/073794, mailed Apr. 5, 2011.

(Continued)

*Primary Examiner* — Victor Batson
*Assistant Examiner* — David Upchurch
(74) *Attorney, Agent, or Firm* — Kilpatrick Townsend & Stockton LLP

(57) ABSTRACT

An incorporated slide fastener that is incorporated simultaneously with the weaving of the fastener tape for a zigzag-type continuous element. The weft yarn of the fastener tape is woven with one thread traversing and doubling back in the tape width direction, forming a set of two threads. Fastener elements have: engaging heads; first and second leg portions that each extend in the width direction of the tape; first connecting portions that connect first legs that are adjacent in the longitudinal direction of the tape; and second connecting parts that connect second legs that are adjacent in the longitudinal direction of the tape. Of the two yarns configuring the weft yarn, one yarn is woven diagonally straddling the first surface of a first leg and the second surface of a second leg of adjacent fastener elements.

6 Claims, 5 Drawing Sheets

(56) References Cited

U.S. PATENT DOCUMENTS

| | | | | |
|---|---|---|---|---|
| 4,227,555 | A * | 10/1980 | Ofusa | A44B 19/346 139/384 B |
| 4,271,871 | A | 6/1981 | Motta | |
| 5,140,725 | A | 8/1992 | Matsushima | |
| 5,794,460 | A * | 8/1998 | Matsuda | A44B 19/343 24/392 |
| 2001/0027821 | A1 | 10/2001 | Shimono | |
| 2003/0110602 | A1 | 6/2003 | Matsuda et al. | |

FOREIGN PATENT DOCUMENTS

| | | | |
|---|---|---|---|
| CA | 2037425 | C | 3/1995 |
| CA | 2338026 | A | 9/2001 |
| CN | 1310971 | A | 9/2001 |
| CN | 1433726 | A | 8/2003 |
| DE | 69103557 | C | 4/2002 |
| EP | 0376140 | A2 | 7/1990 |
| EP | 448265 | A1 | 9/1991 |
| EP | 1133934 | A2 | 9/2001 |
| EP | 1319349 | A1 | 6/2003 |
| ES | 2064038 | T | 9/1991 |
| FI | 910911 | | 9/1991 |
| HK | 104297 | A | 8/1997 |
| HK | 1053955 | A | 9/2005 |
| ID | 29508 | A | 9/2001 |
| JP | 57-058922 | B | 12/1982 |
| JP | 02-177902 | A | 7/1990 |
| JP | 3-118009 | | 12/1991 |
| JP | 2002-85113 | A | 3/2002 |
| JP | 2003-180413 | A | 7/2003 |
| KR | 20-1993-0001713 | Y | 4/1993 |
| KR | 10-2001-0087265 | A | 9/2001 |
| KR | 10-2003-0048343 | A | 6/2003 |
| TW | 237553 | B | 1/1995 |
| TW | 508225 | B | 11/2002 |

OTHER PUBLICATIONS

Supplementary Search Report, European Patent Application No. 10861342.3, mailed Jul. 8, 2015.

* cited by examiner

INCORPORATED SLIDE FASTENER

TECHNICAL FIELD

This application is a national stage application of PCT/JP2010/073794 which is incorporated herein by reference.

The invention relates to an incorporated slide fastener in which a synthetic resin made monofilament is formed in a zigzag shape and a zigzag-type fastener element row of which a width direction-center is doubled in a longitudinal direction thereof is incorporated into one side edge simultaneously with weaving of a fastener tape.

BACKGROUND ART

A method of manufacturing a slide fastener by incorporating and fixing a continuous fastener element acquired by forming a monofilament made of synthetic resin along one side edge of a fastener tape simultaneously with weaving the fastener tape has been widely known. A representative example of the incorporated fastener element at this time includes a coil-shaped continuous fastener element and a zigzag-type continuous fastener element. The continuous fastener elements include engaging heads that engage with elements of opposing fastener stringers, connecting portion that connect adjacent elements, a pair of upper and lower leg portions that couple the engaging heads and the connecting portions, and they are, in advance, formed to be incorporated and sewn into the fastener tape or incorporated into the fastener tape while being formed during weaving.

However, the coil-shaped continuous fastener element is attached onto one surface of the fastener tape regardless by incorporating or sewing. As a result, in a case of the slide fastener, when the slide fastener is bent down with a side where the fastener element is placed facing up, the slide fastener is easily bent, but when the slide fastener is bent up, the slide fastener is difficult to bend. Meanwhile, when the slide fastener is intended to be bent down, disengagement of elements, that is, break in the engagement easily occurs.

Unlike this, in the slide fastener to which the zigzag-type continuous fastener element is attached, the element is attached to the fastener tape while the fastener tape is inserted into a continuous element row which is doubled back and connecting portions that connect two adjacent elements to each other are alternately exposed on front and back surfaces of the fastener tape and shapes thereof are front-back symmetrical to each other. Therefore, front and back are not clear by an appearance and a touch as the fastener stringer and further, even though the slide fastener is bent in a longitudinal direction of the tape while the elements engage with each other, there is no change in flexibility that the slide fastener is bent in front and back directions and the engagement breaking is not also likely to occur. However, in a general slide fastener in prior art, in which a zigzag-type continuous fastener element is incorporated simultaneously with weaving of a fastener tape, a weft yarn may be incorporated through a connecting portion that connects adjacent elements from outside and in this case, the weft yarn is easily cut because an inner surface of a slider is in slide contact with the weft yarn, and as a result, the slide fastener does not endure long use.

A slide fastener attached with the zigzag-type continuous fastener element to overcome the disadvantage is disclosed in, for example, JP 57-058922 B (Patent Document 1) and JP 02-177902 A (Patent Document 2). Among them, according to Patent Document 1, while the fastener tape is formed by double weaving for each element of the zigzag-type continuous fastener element, an upper tape part is woven so as to cover an upper surface with weft yarns and a plurality of warps disposed at an upper portion of an upper leg portion of a preceding element and a lower tape part is woven so as to cover a lower surface with weft yarns and a plurality of warps disposed at a lower portion of a lower leg portion of a subsequent element, and a fastener tape main body portion having one sheet of tape surface is woven by collecting the weft yarns on the tape surface of the fastener tape subsequent to a boundary of upper and lower connecting portions of the respective elements.

Further, according to the slide fastener attached with the zigzag-type continuous fastener element disclosed in Patent Document 2, the zigzag-type fastener element is incorporated, a base organization of an element attaching portion of the fastener tape is inserted between the upper and lower connecting portions of the zigzag-type fastener element, and warps of the base organization is used from the outside of upper and lower leg portions in order to fix the upper and lower leg portions of the zigzag-type fastener element. The fastener tape is woven by a needle weaving machine, and as a result, a weft yarn, which reciprocates in a preceding opening, reciprocates in a width direction of the tape to be weft-inserted in a subsequent opening and thereafter, is introduced into the subsequent opening and the process is repeated to perform weaving. According to Patent Document 2, the weft yarn reciprocates twice to be weft-inserted between adjacent fastener elements, that is, so called 2 pick is achieved between two adjacent fastener elements.

PRIOR ART DOCUMENT

Patent Document

Patent Document 1: JP 57-058922 B
Patent Document 2: JP 02-177902 A

DISCLOSURE OF THE INVENTION

Problem to be Solved by the Invention

According to a slide fastener attached with a zigzag type continuous fastener element disclosed in Patent Document 1 having the above configuration, in particular, in a weaving structure of an element attaching portion of a fastener tape in a first embodiment, the upper and lower leg portions are fastened by the weft yarn straddling three upper pressing warps exclusively for the upper leg portion and three lower pressing warps exclusively for the lower leg portion of the zigzag type continuous fastener element row which include an engaging head, upper and lower leg portions, and upper and lower connecting portions connecting upper leg portions and lower leg portions of elements adjacent to each other, for each element to incorporate and attach each element. Herein, the upper and lower pressing warps cross with being weft-inserted three times each between upper and lower connecting portions of the adjacent elements, three weave patterns are formed by plain weaving between the adjacent upper and lower leg portions, and the upper and lower leg portions are alternately fastened and fixed by the upper and lower pressing warps.

In this case, upper and lower warps are separated from each other between the adjacent elements and between the upper and lower leg portions and are not vertically coupled to each other, and as a result, an attachment position of each element easily deviates in a longitudinal direction of the tape. Further, respective openings of the upper pressing warp and the lower pressing warp need to be formed independently on an upper part of the upper leg portion and a lower part of the lower leg portion and further, the weft-insertion positions also need to be vertically different from each other, and as a result, timings of the opening operation and the weft-insertion operation are very complicated, thereby causing complexity on a mechanism.

Meanwhile, in a slide fastener attached with a zigzag type continuous fastener element disclosed in Patent Document 2, while the element attaching portion of the fastener tape is inserted between the upper and lower connecting portions, a weaving structure is formed by crossing the upper and lower exclusive pressing warps with four constituent threads of four warps which reciprocate twice among the adjacent elements and the upper and lower leg portions are independently fastened and fixed with the exclusive pressing warps. In the slide fastener, an attachment strength of the fastener element is secured and the top and the bottom of the upper and lower leg portions that are adjacent to each other are fastened and fixed by the weaving structure with the respective exclusive pressing warps and the weft yarn is used as a constituent thread of one tape which is continuous by using a core thread as a return portion, and thus there is no concern that the element will deviate in the longitudinal direction of the tape. However, according to the slide fastener of Patent Document 2, since four warps exist among the adjacent elements and moreover, the core thread is interposed therebetween, the thickness of the element attaching portion of the fastener tape increases in any case and a size between the upper and lower surfaces of the element also increases, and as a result, it is difficult to acquire a thin slide fastener.

An object of the invention is to provide an incorporated slide fastener attached with a zigzag-type continuous fastener element, which is thin as the entirety of a fastener, sufficiently smooth, and in which a weft yarn is not cut by a slider by decreasing a size between upper and lower leg portions while securing an attachment strength of an element by solving problems of the slide fastener attached with the zigzag type continuous fastener element disclosed in Patent Documents 1 and 2.

Means for Solving the Problems

The object is to provide a slide fastener in which a zigzag-type continuous fastener element row is incorporated into opposed edge portions of a pair of left and right fastener tapes simultaneously with weaving of a fastener tape, includes: an element attaching portion which is extended in a longitudinal direction along one side edge and incorporates and fixes respective fastener elements of a zigzag type continuous element row; and a tape main body portion which is extended in a width direction of the tape, which is adjacent to one side edge of the element attaching portion as a basic configuration of the invention, being characterized in that the fastener tape is constituted by warps and a weft yarn, in the weft yarn, one thread reciprocates and is weft-inserted in a width direction of the tape in a same opening formed among the warps, is returned over fastening warps at a tape side edge of the element attaching portion side and sequentially reciprocates and is weft-inserted in a subsequent opening, and the thread is woven by repeating the operation, the fastener element includes an engaging head which is formed from a monofilament made of synthetic resin and has an engaging portion bulged in a longitudinal direction of the tape in a bending portion bent in a U shape, first and second leg portions which are extended in the width direction of the tape on first and second surfaces of the fastener tape with the tape edge interposed therebetween from the engaging head, a first connecting portion which connects the first leg portions adjacent to each other in the longitudinal direction of the tape in parallel to the tape surface, and a second connecting portion which connects the second leg portions adjacent to each other in the longitudinal direction of the tape in parallel to the tape surface, the first leg portion disposed on the first surface is fastened by intersections of a plurality of first fastening warps and the weft yarn and the second leg portion disposed on the second surface is fastened by intersections of a plurality of second fastening warps and the weft yarn, one constituent thread of the weft yarn in which two constituent threads reciprocate and are weft-inserted in parallel is incorporated diagonally straddling the first surface of the first leg portion by passing between the first fastening warp and the first leg portion, and one constituent thread in the weft yarn in which two constituent threads reciprocate and are weft-inserted in parallel is incorporated diagonally straddling the second surface of the second leg portion of a subsequent fastener element adjacent by passing between the fastening warp and the second leg portion.

According to a preferred aspect, the thread may be weft-inserted into the same opening between the adjacent elements once and further, the thread may be weft-inserted once each and weft-inserted twice in total into different openings between the adjacent elements. When the insertion of the weft yarn into the same opening between the engaging heads reciprocates twice, in a case where, for example, one weft yarn of two weft yarns for one reciprocation travels diagonally on the top of the upper leg portion of a preceding element, one other weft yarn travels diagonally the top of the lower leg portion of a subsequent element adjacent to the preceding element and the operation is repeated. Meanwhile, one weft yarn, which travels along the first leg portion in the same opening between the adjacent elements and is first inserted at second reciprocation, travels in parallel to the longitudinal direction of the upper and lower leg portions. One remaining weft yarn at the second reciprocation travels diagonally on an outer surface of the adjacent second leg portion straddling the second fastening warp at an edge side of the element attaching portion to reach the second fastening warp at a side end of the tape main body portion among a plurality of the second fastening warps and herein, is returned straddling the second fastening warp, travels diagonally on the outer surface of the adjacent first leg portion of the element. The operation is repeated, so that the zigzag type continuous fastener element is attached to the fastener tape. However, the first and second fastening warps are preferably formed in the same number.

Effect of the Invention

In the invention, the largest characteristic is that first and second leg portions of a zigzag type continuous fastener element row are provided in a direction orthogonal to a tape surface, inserted together with one set of two weft yarns which reciprocate in a same opening formed by the first and second fastening warps, for example, the weft yarns are returned over the second fastening warp of a side end at an engaging head and travel diagonally between the second fastening warp and the second leg portion and thereafter, weaves a tape main body portion to reach an ear portion, and a subsequent weft yarn loop is connected to a preceding weft yarn loop entangled in a loop formed at ends of one set of weft yarns constituted by two threads, which are precedent by using, for example, a needle, to return through the same opening.

When the returned weft yarn travels diagonally over a first surface of the first leg portion between a plurality of the first fastening warps and the first leg portion, is returned over the first surface side of the first fastening warp, is inserted into a subsequent opening formed by the first and second fastening warps toward the ear portion, and reaches the ear portion, the weft yarn is entangled with the preceding loop by the needle and thereafter, returns to the same opening similarly as described above and the weft yarn is returned over the second fastening warp of the side end of the engaging head from the bottom diagonally by straddling the second leg portion between the plurality of fastening warps and a second surface of the second leg portion while the weft yarn returns and is inserted into an opening formed between the second fastening warp and the first fastening warp adjacent thereto, is woven up to the ear portion with a predetermined weaving structure, and thereafter, the same operation is repeated to incorporate the zigzag type continuous fastener element row into the fastener tape.

As such, in the slide fastener according to the invention, the first leg portion and the first connecting portion and the second leg portion and the second connecting portion of the zigzag type continuous fastener element attached to an element attaching portion of the fastener tape are disposed so as to be divided into a first surface and a second surface with the fastener tape interposed therebetween. Further, in the zigzag type continuous fastener element, since one constituent thread of two weft yarns, which travel in parallel, is configured to travel diagonally between the engaging heads from the vicinity of the connecting portion of each leg portion between the plurality of first fastening warps and the first surface of the first leg portion and between the second fastening warp and the second surface of the second leg portion, the number of threads constituting the weft yarn, which exists between adjacent fastener elements, can be reduced, and as a result, the entirety of a fastener stringer can be thin, thereby improving flexibility in a longitudinal direction of the tape, and since the first surface and the second surface of the first and second leg portions are alternately fastened and fixed by the first and second fastening warps, and one constituent thread of the weft yarn is alternately disposed on the first surface of the first leg portion and the second surface of the second leg portion of the zigzag type fastener elements, which are adjacent to each other, diagonally by passing under each fastening warp, fastening force for all fastener elements can be acquired and each fastener element can be prevented from being separated from each other in a longitudinal direction of the tape of each fastener element.

MODE(S) FOR CARRYING OUT THE INVENTION

Figure 1:
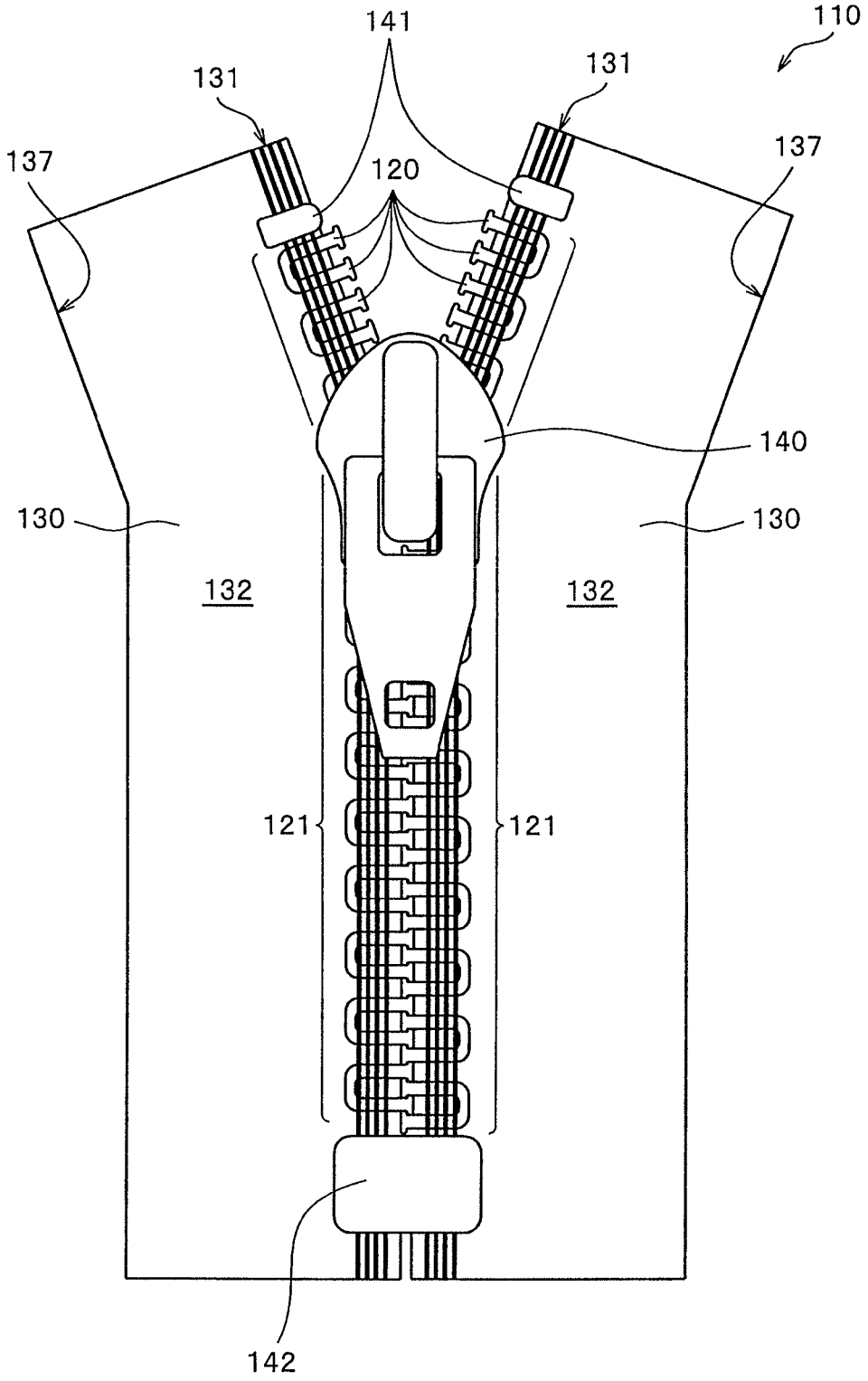
FIG. 1 is a front view of an incorporated slide fastener attached with a zigzag type continuous fastener element according to the invention.

Hereinafter, representative embodiments of the invention will be described in detail with reference to the accompanying drawings. Further, the invention is not limited to the illustrated embodiments and when changes are made within substantially the same scope, various alternations can be made. In addition, a case in which a needle weaving machine, which performs beating by inserting a weft yarn gripped to a front end of a needle into an opening of a warp, is used in weaving a fastener tape to be described below will be described.

FIGS. 1 to 4 illustrate a main part of a slide fastener 110 in which a zigzag type continuous fastener element 120 according to a first embodiment of the invention is incorporated into a fastener tape 130. The fastener tape 130 includes an element attaching portion 131 attached with a zigzag-type continuous element row 121 in which a plurality of fastener elements 120 is continuously formed along one side edge in a width direction of the tape and a tape main body portion 132 which is extended in a width direction of the tape toward an ear portion 137 at an end edge side of the tape not attached with the element row 121 subsequent to the element attaching portion 131. Further, in FIG. 1, reference numeral 140 represents a slider inserted into the left and right continuous element rows 121, reference numeral 141 represents an upper stopper, and reference numeral 142 represents a lower stopper.

Further, in the following description, a direction in which the left and right element attaching portions 131 are closed by the slider is set as an upper direction, a direction in which the left and right element attaching portions 131 are opened is set as a lower direction, and the upper and lower directions are the same as a longitudinal direction of the fastener tape 130. In addition, the width direction of the fastener tape 130 is horizontal to a surface of the fastener tape 130 and is orthogonal to the upper and lower directions, and is also a width direction of the element row. In addition, a direction, which vertically crosses the surface of the fastener tape 130, is a front and rear direction.

Meanwhile, the continuous element rows 121 attached to the element attaching portion 131 are called a zigzag type element row and are acquired by sequentially pressure-forming and bend-forming used locations of one synthetic resin monofilament. A final structure thereof has an engaging head 122 which is bent in a U shape in the width direction of the element row and has an engaging portion 122*b* which is bulged forward and backward in the longitudinal direction of the element row in a bending portion 122*a*, first and second leg portions 123 and 124 which are extended in parallel to the width direction of the element row from each end of the bending portion 122*a*, a first connecting portion 125 which is bent perpendicularly in the longitudinal direction of the element row from the extension end of the first leg portion 123 and connects an extension end of the first leg portions 123 of the adjacent fastener elements 120, and a second connecting portion 126 which is bent perpendicularly in the longitudinal direction of the element row from the extension end of the second leg portion 124 and connects extension ends of the second leg portions 124 of the adjacent fastener elements 120.

In the embodiment, the element attaching portion 131 of the fastener tape 130 has a plurality of first fastening warps 133 that fastens and fixes an outer surface (a first surface side to be described below) of the first leg portion 123 and a plurality of second fastening warps 134 that fastens and fixes an outer surface (a second surface side to be described below) of the second leg portion 124 and the weft yarn 135 is inserted into an opening of each of the fastening warps 133 and 134 to weave the element attaching portion 131. Herein, since the fastener tape 130 is woven by the needle weaving machine, one weft yarn 135 is weft-inserted up to the ear portion 137 by sequentially passing through all warp openings of the tape main body portion 132 while reciprocating and travelling in the opening of each of the first and second fastening warps 133 and 134. One set of two weft yarns 135 which reach the ear portion 137 are interwoven and fixed by confounding the loop end of the preceding weft yarn with a needle 143. In this case, the weft yarn reciprocates in the same opening so that one beating operation, that is, one pick is made. A weaving structure in the tape main body portion 132 is arbitrary and in the illustrated example, the weft yarns 135 are woven by a 1/1 plane weaving structure in which the weft yarns 135, which are two-folded yarns, is used as one weft yarn.

Meanwhile, in the weaving structure of the element attaching portion 131, a plurality of the first and second fastening warps 133 and 134 are respectively arranged in parallel on the first and second surfaces of the first and second leg portions 123 and 124 and the weft yarn 135 constituted by two constituent threads 135-1 and 135-2 travels in openings sequentially formed with the first and second fastening warps 133 and 134 based on the weaving structure to form a base organization of the element attaching portion 131. Herein, the first surface indicates a surface of a near side of the page in FIG. 2 and the second surface indicates a surface of a far side of the page in the same figure.

The first leg portion 123 and the first connecting portion 125 are formed on the first surface side of the fastener tape 130 and the second leg portion 124 and the second connecting portion 126 are formed on the second surface side of the fastener tape 130. The first and second leg portions 123 and 124 which are arranged in parallel to the first and second surfaces are inserted into the same opening formed by the first and second fastening warps 133 and 134 together with the weft yarn 135 constituted by the two constituent threads 135-1 and 135-2, while sequentially forming the zigzag type continuous element rows 121 by using a mandrel (not illustrated) simultaneously with the weaving of the element attaching portion 131. That is, in the element attaching portion 131, the weft yarn 135 constituted by the two constituent threads 135-1 and 135-2 and the two first and second leg portions 123 and 124 are simultaneously inserted into the same opening formed by the first and second fastening warps 133 and 134, and as a result, the respective fastener elements 120 are sequentially incorporated into the fastener tape 130 of the element attaching portion 131.

Figure 4:
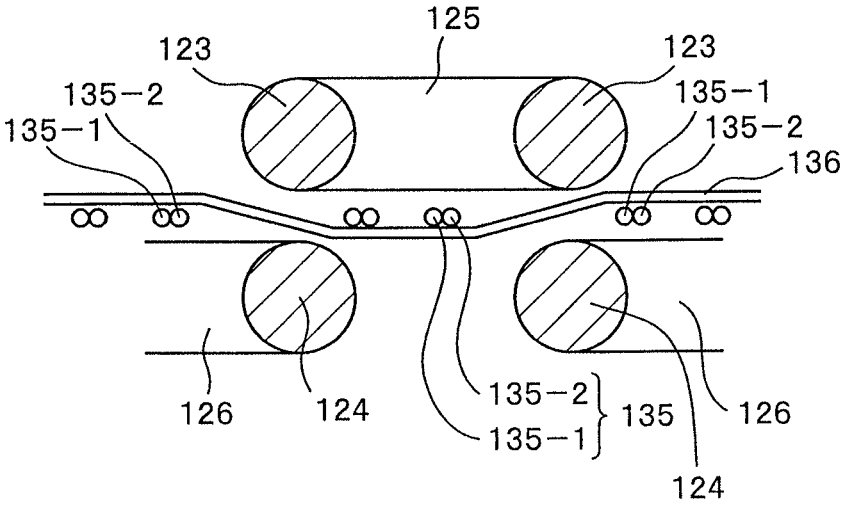
FIG. 4 is a cross-sectional view in an arrow direction along line IV-IV of FIG. 2.
Figure 5:
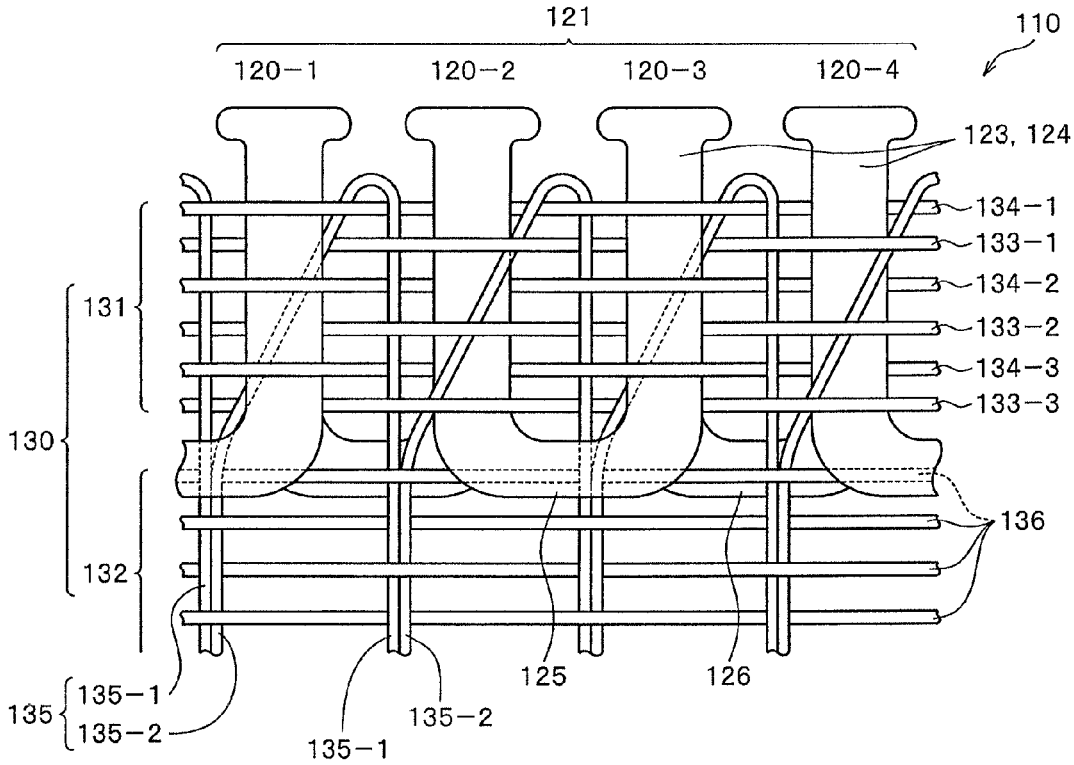
FIG. 5 is an enlarged front view schematically illustrating a main part of an incorporated slide fastener according to a second embodiment of the invention.

A weaving structure of the element attaching portion 131 including the fastener elements 120 (120-1, 120-2, 120-3, and 120-4) will be described in detail with reference to FIGS. 4 and 5 illustrating the front view on the first and second surfaces of the element attaching portion 131. Further, in the figures, for easy understanding, respective branch numbers are attached to the respective fastener elements 120, the first and second fastening warps 133 (133-1, 132-2, and 133-3) and 134 (134-1, 134-2, and 134-3), and two constituent threads of the weft yarns 135 which travel in parallel. However, as described above, the weft yarn 135 is constituted by a single continuous thread.

In the illustrated example, the first and second fastening warps 133 and 134 are constituted by four for each, that is, total eight warps 133-1 to 133-4 and 134-1 to 134-4.

Now, in FIG. 5, the first fastener element 120-1 illustrated at a leftmost end to the third fastener element 120-3 will be described based on the waving structure of the warps 133-1 to 133-4 and 134-1 to 134-4 and the constituent threads 135-1 and 135-2 of the weft yarn 135.

Among the warps 133-1 to 133-4 and 134-1 to 134-4, four warps 133-1 to 133-4 are disposed on the first surface (a surface of a near side of the page in FIG. 2) of the first leg portion 123 and similarly, four warps 134-1 to 134-4 are disposed on the second surface (a surface of a near side of the page in FIG. 3) of the second leg portion 124. According to the embodiment, two weft-insertion operations are performed between the adjacent fastener elements 120-1 to 120-6. In one weft-insertion operation, as described above, a weft-inserted needle (not illustrated) reciprocates in the opening formed by the first and second fastening warps 133 and 134, and as a result, one weft yarn 135 passing through an eyelet of a front end of the weft-inserted needle also reciprocates in the opening and becomes one set of weft yarns 135 while the two constituent threads 135-1 and 135-2 are aligned, and is inserted into the opening. Therefore, four respective threads (constituent threads of the weft yarn) and the first and second leg portions 123 and 124 of the fastener element 120 are inserted into the same opening among the fastener elements 120-1 to 120-2, 120-2 to 120-3, 120-3 to 120-4, and the like.

When the weft yarn 135 reciprocates in the same opening, and as a result, the constituent thread 135-1 reaches the ear portion 137 of the end edge of the tape opposite to the element attaching portion 131, the needle 143 disposed around the end edge of the tape waits while being inserted into a loop formed at a return end of the previous weft yarn 135 which is precedently weft-inserted. When the constituent thread 135-1 reaches an end edge of the ear portion 137 of the tape, the constituent thread 135-1 is suspended on a hook portion of the needle 143 and thereafter, the weft yarn 135 formed in the previous weft-insertion while forming the loop in the constituent thread 135-1 is drawn through the loop and waits until subsequent weft-insertion by holding a new formed loop. The ear portions 137 of the fastener tapes 130 are sequentially formed by repeating the operation.

Meanwhile, of the two constituent threads 135-1 and 135-2 inserted into the same opening by one weft-insertion, one constituent thread 135-2, which returns to the end edge of the tape at the element attaching portion 131 side in the opening by the returning operation of the weft-insertion needle (not illustrated), returns over the first or second fastening warp 133 or 134 disposed at an outermost side of the element attaching portion 131 in the subsequent weft-insertion and is inserted into warp openings adjacent to each other, which are formed next. Therefore, while the two constituent threads 135-1 and 135-2 which reciprocate and are inserted in the same opening are divided forward and backward in the longitudinal direction of the tape at the end edge portion of the tape of the element attaching portion 131 side, the respective threads alternately return in sequence over the first and second fastening warps 133 and 134 disposed at the end edge of the tape and the fastener elements 120-1 to 120-2, 120-2 to 120-3, and 120-3 to 130-4, and the like are sequentially incorporated to continuously manufacture a fastener stringer in which the fastener element row 121 is attached to the fastener tape 130.

Figure 2:
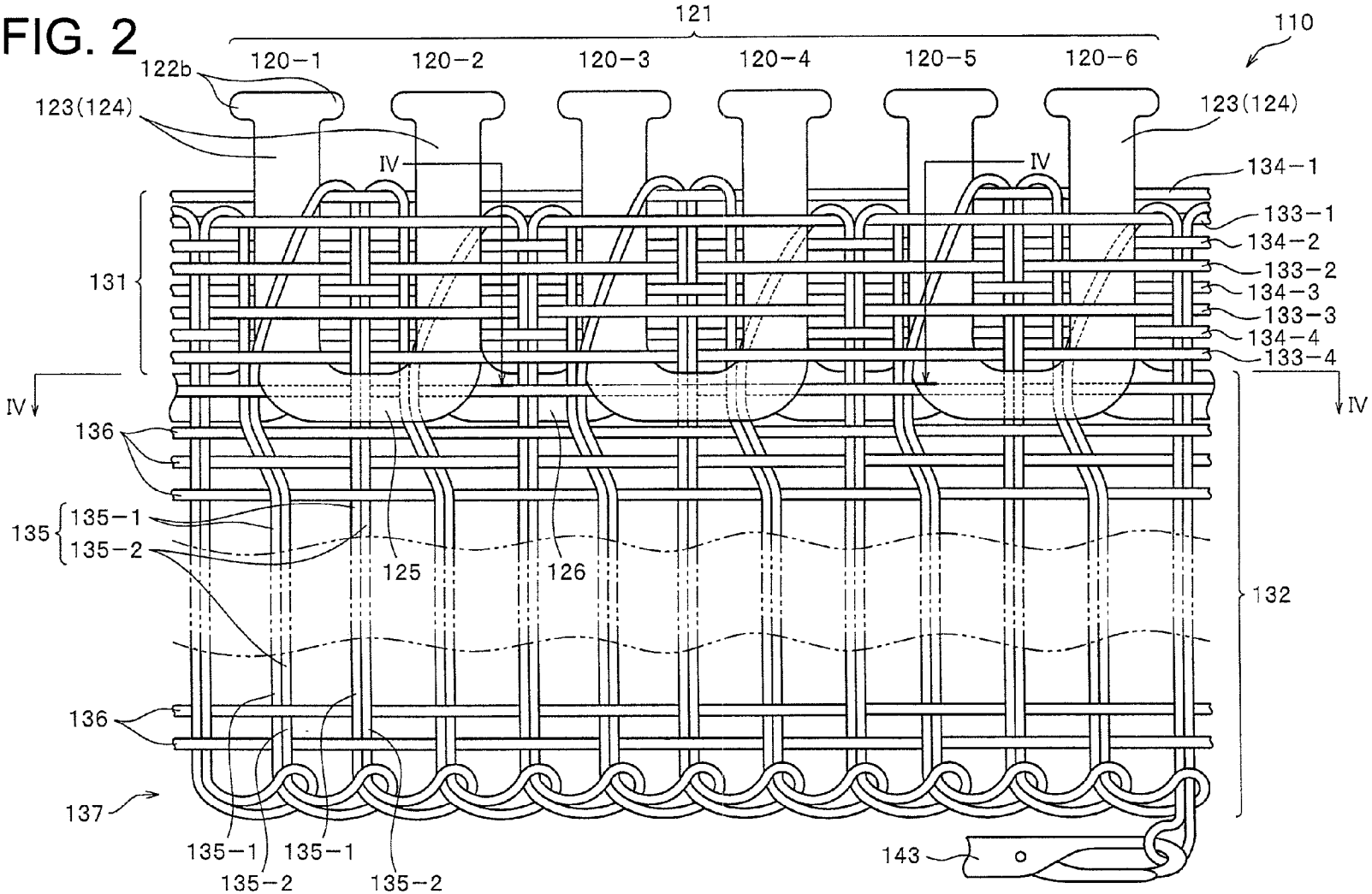
FIG. 2 is an enlarged front view schematically illustrating a main part of the incorporated slide fastener according to a first embodiment.
Figure 3:
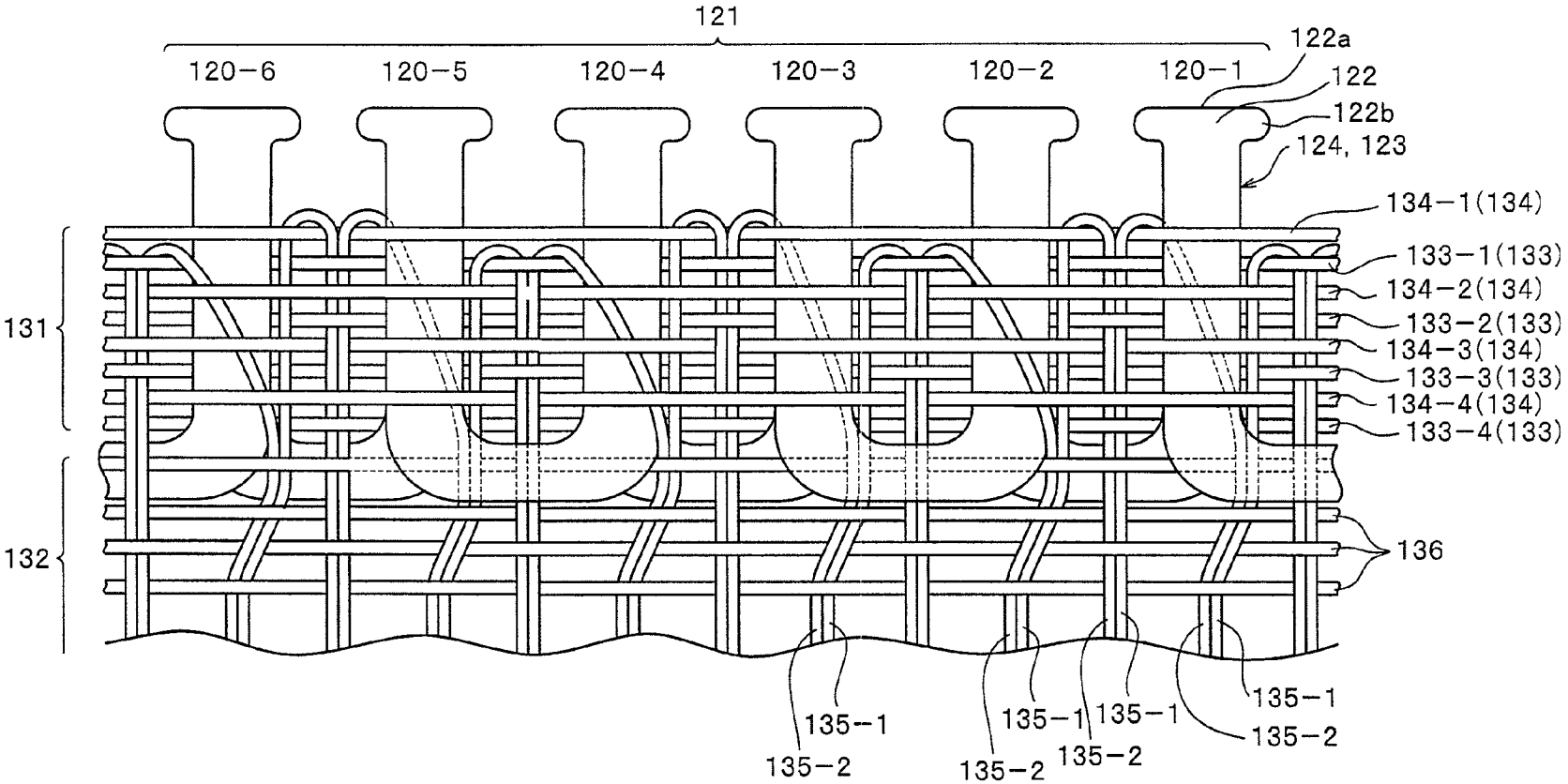
FIG. 3 is a rear view of a main part of the incorporated slide fastener illustrated in FIG. 1.

Subsequently, the weaving structure of a fastener stringer in which the zigzag type continuous fastener element row according to the first embodiment of the invention is incorporated, which is illustrated in FIGS. 2 and 3, will be described in detail based on the aforementioned basic manufacturing process of the fastener stringer.

In FIG. 2, in the warp 134-1 at an uppermost end (the end edge of the fastener tape) positioned on the second surface of the second leg portion 124 in the leftmost fastener element 120-1, one constituent thread 135-2 which returns to the element attaching portion 131 returns over the warp 134-1 to the second surface side from the first surface side. The constituent thread 135-1 as the returned constituent thread 135-1 is inserted into a subsequent opening formed by a total of eight in groups of four in each of the first and second fastening warps 133 and 134 of uppermost and second warps 134-1 and 133-1 of the second and first surface sides, third and fourth warps 134-2 and 133-2 of the second and first surface sides, fifth and sixth warps 134-3 and 133-4 of the second and first surface sides, and seventh and eighth warps of the second and first surface sides, incorporated into a warp 136 for a base organization of the tape main body portion 132, and turns around the ear portion 137 opposite to the element attaching portion 131 to return in the same opening toward the element attaching portion 131 as the constituent thread 135-2. Therefore, the two constituent threads 135-1 and 135-2 are inserted into the same opening.

In this case, in the warp 134-1 disposed at the previous uppermost of the first surface side and the warp 134-4 disposed at an eighth stage, which fasten and fix the first leg portion 123 disposed at the leftmost side of FIG. 2, all of the warps 133-1 to 133-4 on the first surface side cross the first surface of the first leg portion 123 and all of the warps 134-1 to 134-4 on the second surface side cross the second surface of the second leg portion 124, and the first and second leg portions 123 and 124 of all of the fastener elements 120 are fastened simultaneously from the first surface of the first leg portion 123 and the second surface of the second leg portion 124 by intersections of the constituent threads 135-1 and 135-2 of the weft yarn 135, and the respective first fastening warps 133-1 to 133-4 and the respective second fastening warps 134-1 to 134-4.

In FIGS. 2 and 3, the subsequent opening is formed by the second to eighth warps 133-1 to 133-4 in the first surface side, and third to seventh warps 134-2 to 134-4 in the second surface side, and the constituent threads 135-2 and 135-1, and the first and second leg portions 123 and 124 of the second fastener element 120-2 from the left side in FIG. 2 are simultaneously aligned and inserted into the opening. In this case, of the two constituent threads 135-1 and 135-2 inserted into the subsequent opening, the constituent thread 135-2 that returns to the element attaching portion 131 from the ear portion crosses the second surface of the second leg portion 124 diagonally from the bending portion of the second leg portion 124 and the second connecting portion 126, is returned over the second warp 133-1 of the first surface side crossing the first surface of the first leg portion 123 to the first surface side from the second surface, and is inserted into the subsequent opening, as illustrated by a dotted line in FIG. 2. The third opening is formed by the second, fourth, sixth, and eighth warps 133-1 to 133-4 and the third, fifth, and seventh warps 134-2 to 134-4, and the constituent thread 135-1 and the constituent thread 135-2, which returns from the end of the tape at the ear portion 137 side, are inserted into the opening. In this case, the first and second leg portions 123 and 124 of the fastener element 120 are not inserted into the opening together.

Subsequently, a weft-insertion structure of the third fastener element 120-3 from the left side in FIG. 2 will be described. Of one set of two weft yarns 135 which are beaten at a second time between the second and third fastener elements 120-2 and 120-3 from the left side in FIG. 2, the constituent thread 135-2 that returns to the element attaching portion 131 from the ear portion crosses the first surface of the first leg portion 123 diagonally from the bending portion of the first leg portion 123 and the first connecting portion 125 of the third fastener element 120-3, is returned to the second surface side from the first surface side over the first warp 134-1 of the second surface side crossing the second surface of the first leg portion 123, and is inserted into the subsequent opening. In this case, the fourth opening is formed by the uppermost, third, fifth, and seventh warps 134-1 to 133-4 and the second, fourth, sixth, and eighth warps 133-1 to 133-4, and the constituent thread 135-1, the constituent thread 135-2 that returns from the end of the tape at the ear portion 137 side, and the third fastener element 120-3 are together inserted into the opening.

In the fastener stringer in which the zigzag type continuous fastener element row is incorporated according to the embodiment, as illustrated in FIG. 5, a part of the tape main body portion 132 of the fastener tape 130 is disposed to be interposed among the first leg portion 123 and the first connecting portion 125 and the second leg portion 124 and the second connecting portion 126 of the zigzag type continuous fastener element row 121 attached to the element attaching portion 131. In the weft-insertion structure, for example, the constituent thread 135-2 of the weft yarn 135, which returns into the same opening that crosses diagonally over the first surface of the first leg portion 123 and the second surface of the second leg portion 124 of three adjacent fastener elements 120-1 to 120-3 in FIG. 2, is divided into the first and second surfaces of the first and second leg portions 123 and 124 every weft insertion, alternately travels diagonally between the first element fastening warps 133-2 to 133-4 and the second element fastening warps 134-1 to 134-4, and the first and second leg portions 123 and 124, and is pressed to each leg portion side by each warp. As a result, since each fastener element 120 is fastened by the first and second fastening warps 133 and 134 and simultaneously fastened by even the constituent thread 135-2, fastening force to each fastener element 120 is further increased.

One constituent thread 135-2 of the weft yarn 135 diagonally straddling over the first surface of the first leg portion 123 is incorporated through the second surface side of the warp adjacent to the element attaching portion 131 of the tape main body portion 132 and thereafter, is returned through the outer surface of the first leg portion 123 and the second surface side of the fastening warps 133-1 to 133-4 to fasten and fix the first leg portion 123 diagonally straddling the first leg portion.

Further, one constituent thread 135-2 of the weft yarn 135 diagonally straddling over the second surface of the second leg portion 124 is incorporated through the first surface side of the warp adjacent to the element attaching portion 131 of the tape main body portion 132 and thereafter, passes between the outer surface of the second leg portion 124 and the fastening warps 134-1 to 133-4, and is returned through the first surface side of the first fastening warp 133-1 at a second stage of the element attaching portion 131 to fasten and fix the second leg portion 124 diagonally straddling the second leg portion.

One of the two constituent threads 135-1 and 135-2 constituting the weft yarn 135, which travels diagonally on the first and second leg portions of the fastener element 120, moves to the first and second leg portions 123 and 124 from between the fastener elements which are substantially adjacent to each other. As a result, the number of constituent threads of the weft yarn 135 that substantially exist between the adjacent fastener elements 120 decreases. Therefore, the fastener stringer may be thin as a whole, longitudinal flexibility of the tape is improved. In this case, since the constituent thread 135-2 that returns diagonally over each of the first and second leg portions 123 and 124 is returned to the second surface side from the first surface side or in an opposite side thereto over the warp 133-1 or 134-1 disposed at the end edge of the element attaching portion 131 side, and the constituent threads 135-1 and 135-2 of the weft yarn 135 diagonally over the first and second leg portions 123 and 124 are not displaced in the longitudinal direction of the tape in crossing two warps 136 for a base organization adjacent to the eighth coupling warp 133-4 disposed at an edge portion of an ear portion of the element attaching portion 131.

Among a plurality of the first fastening warps, the first fastening warp 133-1 of the engaging head 122 side is fastened straddling two first leg portions 123 which are adjacent to each other, and further, among a plurality of the second fastening warps, the second fastening warp 134-1 at the engaging head 122 side is fastened straddling two first leg portions 123 which are adjacent to each other. The warp is fastened straddling two leg portions to prevent swing of the leg portion such as excessive spacing between the engaging heads formed at the leg portions. This is similar even in a third embodiment to be described below.

Subsequently, a second embodiment of the invention will be described with reference to FIG. 5. FIG. 5 is a front view of a main part of a fastener stringer attached with a zigzag type continuous fastener element according to a second embodiment of the invention. In the first embodiment, two weft-insertions are performed between the adjacent fastener elements 120, the first and second leg portions 123 and 124 of the fastener element 120 are inserted into the same opening in the second weft-insertion, and incorporated into the fastener tape 130 of the fastener element 120, but in the second embodiment, one weft-insertion is performed between the adjacent fastener elements 120, and the first and second leg portions 123 and 124 are simultaneously inserted while forming the fastener element 120 in the weft-insertion.

In the weft-insertion, the constituent thread 135-2 of the weft yarn 135 that returns from an ear portion (not illustrated) travels diagonally on the second surface (a surface of the leftmost fastener element 120-1 expressed by a dotted line in FIG. 5) of the second leg portion 124, which is bent in the U shape to the second surface side from the first surface side in the engaging head 122 of the fastener tape 130 and extended to the tape main body portion 132, and in subsequent weft-insertion, the constituent thread 135-2 is returned over the second warp 134-1 disposed at a first stage of the engaging head side to the first surface side from the second surface side and is inserted into the opening formed by the second warps 134-1 to 134-3 and the first warps 133-1 to 133-3. The constituent thread 135-1 toward the ear portion (not illustrated), which is returned and inserted into the opening, is inserted into the opening formed by a plurality of base organization warps 136 to reach the ear portion by weaving the tape main body portion 132 and the constituent thread 135-2, which turns around the ear portion similarly as in the first embodiment, travels in the same opening to reach the element attaching portion 131. In this case, in the formed opening, all of the first fastening warps 133 are disposed on the first surface of the first leg portion 123 and the returning constituent thread 135-2 travels diagonally between the first surface of the first leg portion 123 and each of the first warps 133-1 to 133-3. The operation is sequentially repeated, and as a result, the fastener stringer having the weaving structure illustrated in FIG. 5 is manufactured.

The slide fastener 110 attached with the zigzag type continuous fastener element of the invention, which is formed by the fastener stringer having the weaving structure, shows the same operational effect as the first embodiment, and the number of weft-insertion times is small, and as a result, a manufacturing speed is increased up to almost two times to improve production efficiency, and the slide fastener 110 is further thinner and longitudinal smoothness of the tape is also improved, as compared with the fastener stringer of the first embodiment which is woven by the thread having the same fineness as the first embodiment.

Figure 6:
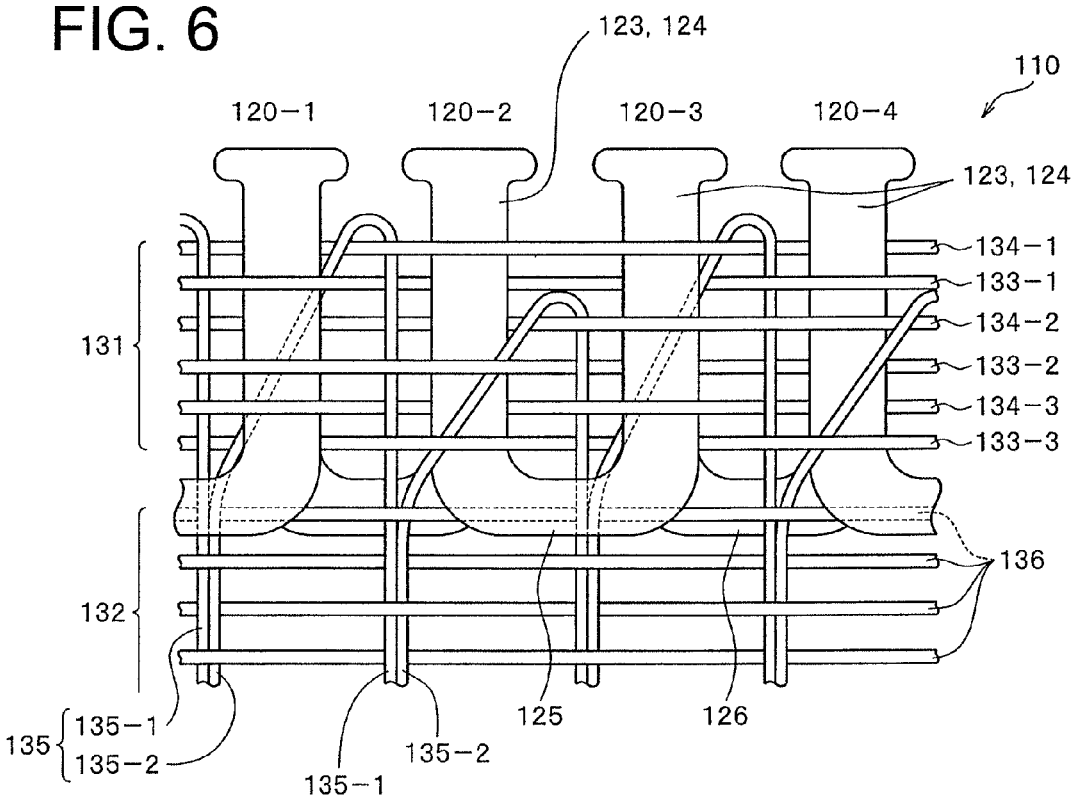
FIG. 6 is an enlarged front view schematically illustrating a main part of an incorporated slide fastener according to a third embodiment of the invention.

FIG. 6 illustrates a third embodiment and according to the embodiment, the third embodiment is the same as the second embodiment in that the number of weft-insertion times among the adjacent fastener elements 120-1, 120-2, and the like is one, but different from the second embodiment in the weaving structure. Even in the embodiment, the first and second fastening warps 133 and 134 include three warps 133-1 to 133-3 and 134-1 to 134-3, respectively and are the same as those of the second embodiment, but different from the second embodiment in the weaving structure with the weft yarn 135.

In the second embodiment, when it is thought that the respective adjacent fastener elements 120 are integrated with the weft yarn 135, the weaving structure is configured by the 1/1 plane weaving structure, but in the third embodiment, the respective adjacent fastener elements 120 are integrated with the weft yarn 135 in the weft-insertion and in the weaving structure, 2/2 twill weaving is adopted in the first and second fixing warps 133-1 to 133-2 and 134-1 to 134-2 until a fourth stage, and the 1/1 plane weaving structure is adopted in the first and second fixing warps 133-3 to 134-3 at fifth to sixth stages. The operational effect by the embodiment is different from the second embodiment from which the embodiment is derived by a difference of the weaving structure, but is not significantly changed in a main operational effect.

As apprehended in the above description, the invention may adopt various aspects and may be changed according to a purpose such as, for example, the number of fastening warps, the weaving structure thereof, or the weaving structure of the tape main body portion, or the like and is not limited to the illustrated example.

DESCRIPTION OF REFERENCE NUMERALS

110 Slide fastener
120, 120-1 to 120-6 Fastener element
121 Continuous element row
122 Engaging head
123, 124 First and second leg portions
125,126 First and second connecting portions
130 Fastener tape
131 Element attaching portion
132 Tape main body portion
133, 134 First and second fastening warps
133-1 to 133-4 Second, fourth, sixth, and eighth warps at first surface side
134-1 to 134-4 First, third, fifth, and seventh warps at second surface side
135 Weft yarn
135-1, 135-2 Constituent threads of (weft yarn)
136 Warp for base organization
137 Ear portion
140 Slider
141 Upper stopper
142 Lower stopper
143 Needle
122*a* Bending portion
122*b* Engaging portion

The invention claimed is:

1. A slide fastener, including:

a pair of left and right fastener tapes, each fastener tape having:

an element attaching portion which is extended in a longitudinal direction along one edge and incorporates and fixes respective fastener elements of a zigzag type continuous element row; and a tape main body portion which is extended in a width direction of the tape adjacent to one edge of the element attaching portion, the zigzag type continuous element rows being incorporated into opposing edges of the pair of left and right fastener tapes, wherein each fastener tape is constituted by a plurality of first fastening warps, a plurality of second fastening warps, and a weft yarn, wherein the weft yarn includes two threads, one constituent thread reciprocates and is weft-inserted in the width direction of the fastener tape in an opening formed among the fastening warps, is returned over at least one of the fastening warps at a tape edge of the element attaching portion side and sequentially reciprocates and is weft-inserted in a subsequent opening, each of the fastener elements includes an engaging head which is formed from a synthetic resin monofilament and has an engaging portion bulged in a longitudinal direction of the fastener tape in a bending portion bent in a U shape, first and second leg portions which are extended in the width direction of the fastener tape on a first surface and a second surface of the fastener tape respectively, a first connecting portion which connects the first leg portions adjacent to each other in the longitudinal direction of the tape in parallel to the tape surface, and a second connecting portion which connects the second leg portions adjacent to each other in the longitudinal direction of the tape in parallel to the tape surface, the first leg portion disposed on the first surface is fastened by intersections of the plurality of first fastening warps and the weft yarn and the second leg portion disposed on the second surface is fastened by intersections of the plurality of second fastening warps and the weft yarn, the two threads reciprocate and are weft-inserted in parallel and the one constituent thread of the weft yarn diagonally straddles the first surface of the first leg portion by passing between at least some of the plurality of first fastening warps and the first leg portion, and the one constituent thread of the weft yarn diagonally straddles the second surface of the second leg portion of an adjacent fastener element by passing between at least some of the plurality of second fastening warps and the second leg portion.

2. The slide fastener according to claim 1, wherein:

in a warp adjacent to the element attaching portion of the tape main body portion, the one constituent thread of the weft yarn diagonally straddling over the first surface of the first leg portion is incorporated by passing through the second surface side of the adjacent warp, and the one constituent thread of the weft yarn diagonally straddling over the second surface side of the second leg portion is incorporated by passing through the first surface side of the adjacent warp.

3. The slide fastener according to claim 1 wherein:

a selected first fastening warp of the plurality of first fastening warps on an engaging head side straddles two adjacent first leg portions, and a selected second fastening warp of the plurality of second fastening warps on the engaging head side straddles two adjacent second leg portions.

4. The slide fastener according to claim 1, wherein:

the weft yarn is weft-inserted twice between the adjacent fastener elements.

5. The slide fastener according to claim 1, wherein:

the weft yarn is weft-inserted once between the adjacent fastener elements.

6. The slide fastener according to claim 1, wherein:

a number of the plurality of first fastening warps and a number of the plurality of second fastening warps is the same.

* * * * *

UNITED STATES PATENT AND TRADEMARK OFFICE

CERTIFICATE OF CORRECTION

PATENT NO. : 9,339,087 B2
APPLICATION NO. : 13/976646
DATED : May 17, 2016
INVENTOR(S) : Eiji Nishida It is certified that error appears in the above-identified patent and that said Letters Patent is hereby corrected as shown below:

On the title page item (57), in column 2, in "Abstract", line 3, delete "element." and insert -- element row. --, therefor.

Signed and Sealed this
Nineteenth Day of July, 2016

Michelle K. Lee

Michelle K. Lee
*Director of the United States Patent and Trademark Office*